US005443129A

United States Patent [19]

Bailey et al.

[11] Patent Number: 5,443,129

[45] Date of Patent: Aug. 22, 1995

[54] APPARATUS AND METHOD FOR ORIENTING AND SETTING A HYDRAULICALLY-ACTUATABLE TOOL IN A BOREHOLE

[75] Inventors: Thomas F. Bailey; Barry R. Scott, both of Houston, Tex.

[73] Assignee: Smith International, Inc., Houston, Tex.

[21] Appl. No.: 279,489

[22] Filed: Jul. 22, 1994

[51] Int. Cl.[6] ..... E21B 47/01; E21B 7/04

[52] U.S. Cl. ..... 175/45; 175/61; 175/317; 166/117.6

[58] Field of Search ..... 166/332, 334, 117.6, 166/134; 175/38, 61, 62, 45, 317, 322

[56] References Cited

U.S. PATENT DOCUMENTS

| | | | |
|---|---|---|---|
| 4,298,077 | 11/1981 | Emery | 175/317 X |
| 4,397,355 | 8/1983 | McLamore | 166/297 |
| 4,765,404 | 8/1988 | Bailey et al. | 166/117.6 |
| 4,771,831 | 9/1988 | Pringle et al. | 166/332 X |
| 4,889,199 | 12/1989 | Lee | 175/317 |
| 5,004,007 | 4/1991 | Johnson et al. | 166/117.5 X |
| 5,109,924 | 5/1992 | Jürgens et al. | 166/117.6 X |
| 5,139,094 | 8/1992 | Prevedel et al. | 175/61 |
| 5,156,220 | 10/1992 | Forehand et al. | 166/332 X |
| 5,181,569 | 1/1993 | McCoy et al. | 166/332 X |
| 5,222,554 | 6/1993 | Blount et al. | 166/117.6 |
| 5,335,737 | 8/1994 | Baugh | 166/117.6 X |
| 5,341,883 | 8/1994 | Ringgenberg | 166/334 |

OTHER PUBLICATIONS

Anadrill and Eastman Teleco, "State of the Art in MWD," produced and distributed by International MWD Society, Jan. 19, 1993, pp. 1–26.

Technical Information Brochure, "Casing Sidetrack Systems: Pack-Stock® and Anchor-Stock®," published by A-Z/Grant International Company, Houston, Texas, pp. 1–6.

Bonner, S., Burgess, T., Clark, B., Decker, D., Lüling, M., Orban, J., Prevedel, B., and White, J., "Measurements at the Bit: A New Generation of MWD Tools," Oilfield Review, vol. 5, Apr./Jul. 1993, pp. 44–54.

Engineering specifications manual entitled "Operation Procedure for the Pack-Stock and Anchor-Stock," A-Z/Grant International Company, Houston, Texas, Nov. 4, 1992, pp. 1–53.

*Primary Examiner*—Michael Powell Buiz
*Assistant Examiner*—Frank S. Tsay
*Attorney, Agent, or Firm*—Gregory L. Maag; Conley, Rose & Tayon

[57] ABSTRACT

An apparatus for detecting and properly orienting a hydraulically-actuatable tool in a borehole and commencing drilling in a single trip of the drill string includes an MWD subassembly, for sensing the orientation, and a bypass valve for setting the hydraulically-actuatable tool once it is properly oriented and for thereafter conducting the drilling fluid to the cutter assembly. The method of setting a hydraulically-actuatable tool and commencing drilling in a single trip of the drill string includes the steps of running the hydraulically-actuatable tool into the borehole on a drill string which includes an MWD subassembly, sensing the orientation using the MWD subassembly, orienting the drill string to the desired orientation, and setting the hydraulically-actuatable tool.

29 Claims, 6 Drawing Sheets

APPARATUS AND METHOD FOR ORIENTING AND SETTING A HYDRAULICALLY-ACTUATABLE TOOL IN A BOREHOLE

FIELD OF THE INVENTION

This invention relates generally to methods and apparatus for orienting a tool in a borehole and, once properly oriented, setting the tool in a fixed position. More particularly, the invention relates to the use of an MWD tool for properly orienting a sidetrack system that is comprised of a whipstock and an anchor-packer, and for milling a window in the borehole casing in a single trip of the drill string. Still more particularly, the invention relates to a bypass valve that, when open, permits drilling mud to circulate in the drill string at rates required by the MWD tool for orienting the sidetrack system and, when closed, sets the anchor-packer and conducts the drilling mud to the cutter assembly used to cut the casing window.

BACKGROUND OF THE INVENTION

The industry that is associated with the drilling of oil and gas wells has long used hydraulically-actuated tools such as packer or anchor assemblies to support other tools in the borehole. One such tool used in conjunction with anchors or packers is a whipstock. A whipstock includes an inclined face and is typically used to direct a drill bit or cutter in a direction that deviates from the existing wellbore. The combination whipstock and anchor (or packer) is frequently termed a sidetrack system. Sidetrack systems have traditionally been used to mill a window in the well casing, and thereafter to drill through the casing window and form the new borehole.

Originally, such a sidetrack operation required two trips of the drill string. The first trip was used to run and set the anchor or packing device at the appropriate elevation in the borehole. With the anchor or packer in place, the drill string was then removed from the well and a survey was made to determine the orientation of a key on the upper end of the anchor-packer. With that orientation known, the whipstock was then configured on the surface so that when the whipstock engaged the anchor-packer in the borehole, it would be properly oriented. So configured, the whipstock, along with an attached cutter, was then lowered in the wellbore on the drill string and secured to the anchor-packer. Once connected to and supported by the packer, the whipstock directed the cutter so that a window would be milled in the casing of the wellbore at the desired elevation and in the preselected orientation. As is apparent, this two-trip operation for setting the anchor-packer and then lowering the whipstock and cutter is time-consuming and expensive, particularly in very deep well operations.

To eliminate the expense associated with two trips of the drill string, an improved sidetrack system was developed which required only a single trip. Such a system is described, for example, in U.S. Pat. Nos. 4,397,355 and 4,765,404 and includes a whipstock having an anchor-packer connected at its lower end, and a cutter assembly releasably connected at its upper end. Using such a system, the whipstock is oriented by first lowering the apparatus into the cased wellbore on a drill string. A wireline survey instrument is then run through the drill string to check for the proper orientation of the suspended whipstock. In generally vertical wellbores, the wireline tool typically can be lowered in the drilling mud by gravity alone. In heavier muds, however, or in wellbores which deviate from vertical to a significant degree, it is frequently necessary to circulate the drilling mud through the drill string in order the pump the wireline tool from the surface to the whipstock.

To permit the circulation required to transport the wireline sensing device down to the whipstock, prior art systems have included a bypass valve which would allow drilling mud at relatively low flow rates (typically less than 100 g.p.m) to circulate through the drill string without setting the hydraulically-actuated anchor-packer. Once the wireline sensor has been transported by the circulating drilling mud to the location required for detecting the orientation of the whipstock, and after the whipstock is properly oriented in the borehole, the bypass valve could then be closed and the drill string pressurized so as to actuate the anchor-packer. With the anchor-packer set, the drill string is then lowered causing the cutter assembly to become disconnected from the whipstock. As the cutter is lowered further, the inclined surface of the whipstock cams the rotating cutter against the well casing, causing the cutter to mill a window in the casing at the predetermined orientation and elevation.

While the single-trip method and apparatus described above is an improvement over the prior two-step system, it nevertheless suffers from significant drawbacks. As mentioned above, it is many times difficult to transport the wireline sensor into the position that is required for detecting the orientation of the drill string when drilling with heavy drilling muds. It has likewise been found to be quite difficult to transport the wireline sensor and have it properly engage the whipstock assembly in wellbores that deviate significantly from vertical. Because in today's drilling industry, where steerable systems are frequently employed to drill holes horizontally or at angles that even exceed horizontal, it should be appreciated that this inability to properly land or connect a wireline device is a very significant drawback to using the technology that is presently available.

To be contrasted with wireline devices, there exist today a variety of systems that are capable of collecting and transmitting data from a position near the drill bit while drilling is in progress. Such measuring-while-drilling ("MWD") systems are typically housed in a drill collar at the lower end of the drill string. In addition to being used to detect formation data, such as resistivity, porosity, and gamma radiation, all of which are useful to the driller in determining the type of formation that surrounds the borehole, MWD tools are also useful in surveying applications, such as, for example, in determining the direction and inclination of the drill bit. Present MWD systems typically employs sensors or transducers which, while drilling is in progress, continuously or intermittently gather the desired drilling parameters and formation data and transmit the information to surface detectors by some form of telemetry, most typically a mud pulse system. The mud pulse system creates acoustic signals in the drilling mud that is circulated through the drill string during drilling operations. The information acquired by the MWD sensors is transmitted by suitably timing the formation of pressure pulses in the mud stream. The pressure pulses are received at the surface by pressure transducers which convert the acoustic signals to electrical pulses which are then decoded by a computer.

MWD tools presently exist that can detect the orientation of the drill string without the difficulties and drawbacks described above that are inherent with the use of wireline sensors. It would thus at first seem advantageous to use such MWD tools in a sidetrack system to orient a whipstock and set a packer, or to actuate any other type of hydraulically-actuated downhole mechanism where achieving a particular orientation is important. Unfortunately, known MWD tools typically require drilling fluid flow rates of approximately 250 gallons per minute to start the tool, and 350 to 400 gallons per minute to gather the necessary data and transmit it to the surface via the mud pulse telemetry system. The conventional bypass valves used in present-day sidetrack systems for circulating drilling fluid and transporting a wireline sensor to the whipstock tend to close, and thereby actuate the anchor-packer, at flow rates of approximately 100 gallons per minute, or even less. Thus, while it might be desirable to combine MWD sensors in a sidetrack system, if drilling mud was circulated through the drill string at the rate necessary for the MWD tool to detect and communicate to the driller the orientation of the whipstock, the bypass valve would close and the anchor-packer would be set prematurely, before the whipstock was properly oriented. Thus, despite the theoretical advantage which an MWD tool could provide in orienting and setting a hydraulically-actuated mechanism, a system presently does not exist to take advantage of the benefits that an MWD tool might provide.

SUMMARY OF THE INVENTION

Accordingly there is provided herein a method and apparatus permitting the use of present day MWD tools to detect the orientation of a whip stock and anchor-packer, or any other downhole hydraulically-actuatable tool, and to commence drilling after the drill string has been properly oriented in a single trip of the drill string. The invention includes a running assembly on a drill string, the assembly including an MWD subassembly, a bypass valve and a cutter.

The bypass valve generally includes a valve body, a piston sleeve assembly in the valve body and a tubular piston retained in the piston sleeve and adapted for reciprocal motion between a fully open and a fully closed position. The piston is fixed in the sleeve in the initial fully open position by shear pins. Longitudinally spaced-apart radial ports formed in the piston sleeve are open when the piston is in the initial position such that drilling fluid pumped through the drill string is conducted out of the drill string through the radial ports in the piston sleeve and through mud intake ports in the valve body. The shear pins are sized so that when drilling fluid is pumped through the drill string at a flow rate within the operational range of the MWD subassembly, for example, at 250–350 gallons per minute, the shear pins will retain the piston in its initial position. The shear pins are sized to release the piston when the drilling fluid flow rate is increased to a higher rate as required for setting the hydraulically-actuatable tool. When the shear pins release the piston, it begins moving toward the fully closed position and first covers and seals a first plurality of the radial ports in the piston sleeve, causing the drilling fluid now to be conducted out of the bypass valve only through the remaining uncovered radial ports. As the piston continues to move toward the closed position, a fluid trap is formed between the sleeve assembly and a reduced diameter portion of the piston so as to dampen and slow the travel of the piston. As the piston approaches the fully closed position, it covers and seals the remaining radial ports causing the fluid pressure in the bypass valve and hydraulically-actuated tool to increase until it reaches the pressure required to set the tool. Once set, the running assembly, which includes the MWD subassembly, bypass valve and cutter is lowered and rotated so as to become disconnected from the hydraulically-actuated tool and so as to commence drilling.

The method disclosed herein includes the step of sensing the orientation of the running assembly and hydraulically-actuatable tool using the MWD subassembly, orienting the drill string to the desired orientation, setting the hydraulically-actuatable tool and then disconnecting the running assembly so as to commence drilling operations.

Thus, the present invention comprises a combination of features and advantages which enable it to substantially advance drilling technology by providing apparatus and methods for using conventional MWD tools as are readily available and typically present on a drilling site to orient the downhole tool, set the tool, and commence drilling, all with a single trip of the drill string. The present invention eliminates the deficiencies in known sidetrack systems, for example, where wireline tools were frequently difficult to use in orienting the downhole hydraulically-actuatable tool. The present invention can be used with drilling fluids of all types and all weights, and can be employed in holes that deviate substantially from vertical. These and various other characteristics and advantages of the present invention will be readily apparent to those skilled in the art upon reading the detailed description of the preferred embodiment and referring to the accompanying drawings.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

In the preferred embodiment, the invention comprises a sidetrack system 10 useful for offsetting a wellbore from its old direction by directing a drill bit or cutter at an angle from the existing wellbore. As will be understood by those skilled in the art, however, the principles of the invention can be applied to orient and fix other downhole, hydraulically-actuated tools in a single trip of the drill string. Thus, it being understood that the sidetrack system 10 is merely the preferred embodiment of practicing Applicants' invention, and that the invention is not limited to a sidetrack system, the preferred embodiment will now be described in greater detail.

Figure 1A:
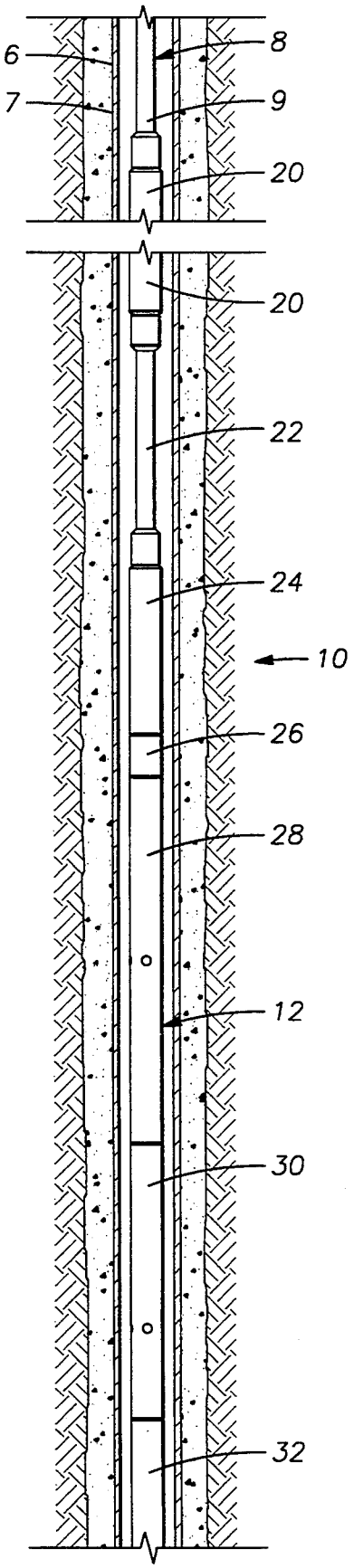
FIG. 1 is an elevation view, partly in cross-section, of a wellbore with the apparatus of the present invention suspended therein, FIG. 1A showing the upper portion and FIG. 1B showing the lower portion of the apparatus.
Figure 1B:
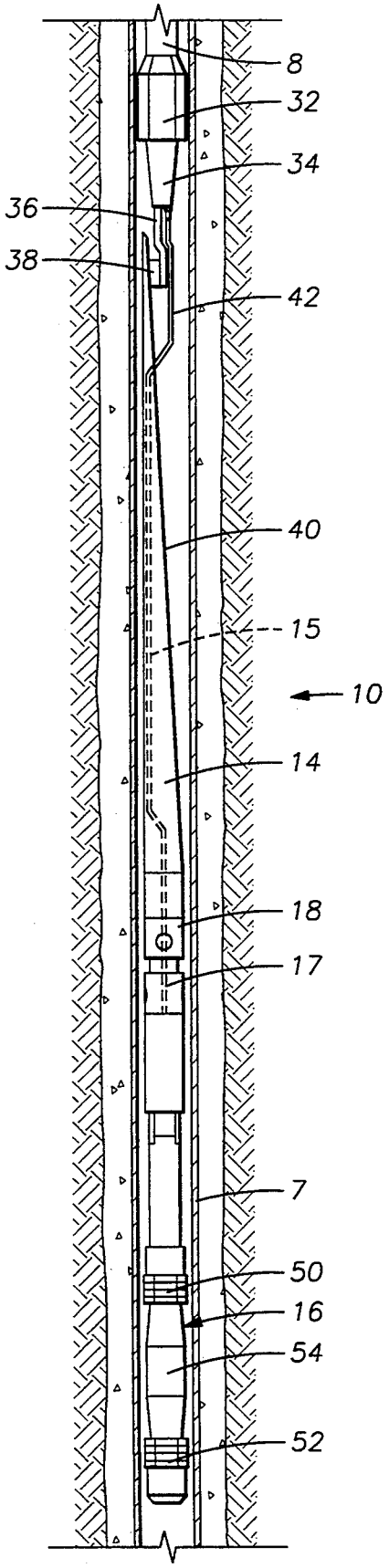

Referring first to FIGS. 1A and 1B, the sidetrack system 10 is shown attached at the lower end of a drill string 8 that is run in a borehole 6. Borehole 6 is typically cased by a well casing 7; however, the invention is not limited to use in a cased well bore, but is equally applicable to open, noncased boreholes. Thus, throughout this disclosure, the term "borehole" shall refer both to cased holes and open holes. Drill string 8 is made up of a series of connected sections of drill pipe 9 and the desired number of drill collars 20 as shown in FIG. 1A. Sidetrack system 10 generally includes a running assembly 12, a whipstock 14 and an anchor-packer assembly 16. Anchor-packer 16 is a hydraulically actuated subassembly which, upon actuation, attaches to the borehole casing at a predetermined elevation so as to seal the portion of the borehole below the anchor-packer from the portion above it, and to provide a platform or support means for other apparatus, in this case, whipstock 14 and running assembly 12. It will be understood that for operation of the sidetrack system 10, the borehole need not be sealed, and thus simply an anchor mechanism, rather than an anchor-packer, may be employed in practicing the present invention. Thus, as used throughout this disclosure, the term "anchor-packer" will refer both to an anchor, and to an anchor and packer assembly in combination.

Figure 10:
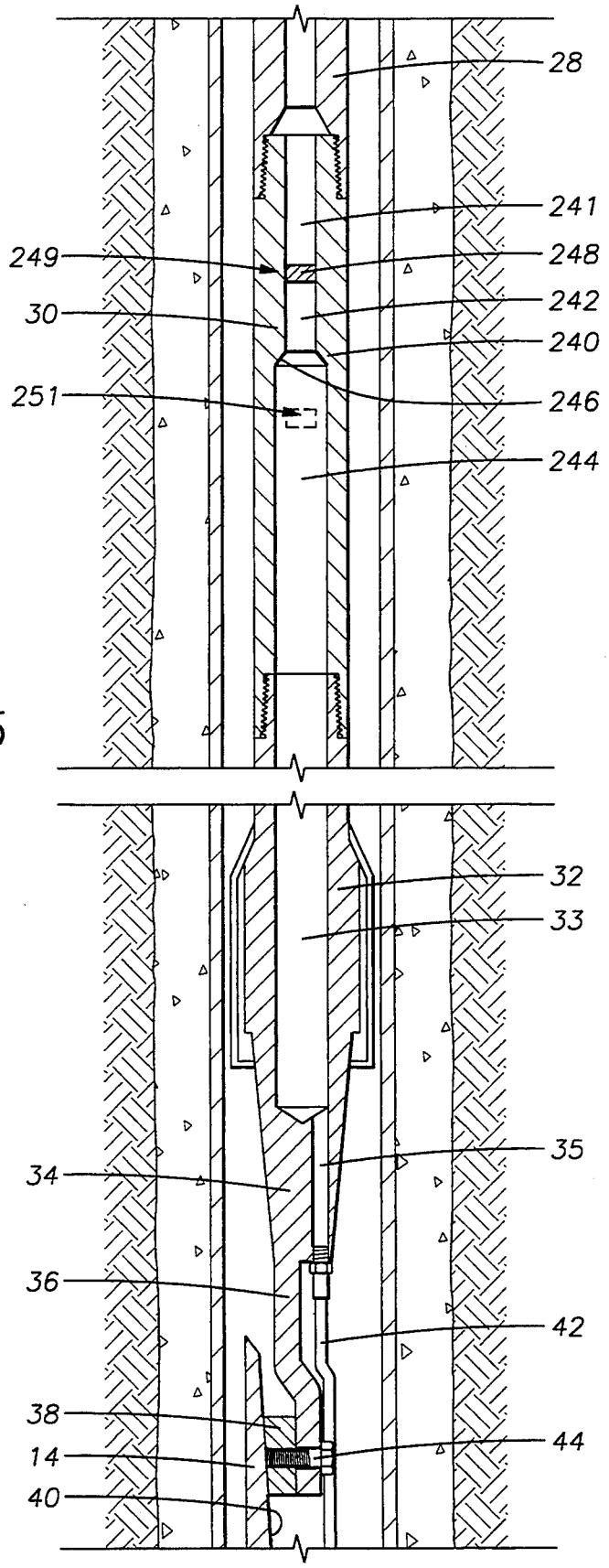
FIG. 10 is an enlarged schematic view of the running tool and starter mill showing the interconnection between the starter mill and the whipstock.

Referring now to FIGS. 1A, 1B and 10, running assembly 12 is connected to the lowermost drill collar 20 by a section of high grade drill pipe 22. Whipstock 14 is suspended from starter mill 32 of running assembly 12. Anchor-packer assembly 16 is connected to whipstock 14 by a connecting sub 18. Anchor-packer 16 is a hydraulically-actuatable mechanism which, upon delivery of a pressurized fluid at a predetermined pressure through internal conduit system 17, becomes set in the casing 7 so as to support whipstock 14. Anchor-packer 16 may be, for example, a packer assembly such as that shown and described in U.S. Pat. No. 4,765,404 or U.S. Pat. No. 4,397,355, the entire disclosures of such patents being hereby incorporated by this reference. Anchor-packer 16 includes a set of upper slips 50 and lower slips 54 which, upon actuation of anchor-packer 16, extend outwardly and engage the inner surface of casing 7. Packer seal 54, positioned between upper and lower slips 50, 54 sealingly engages casing 7 upon actuation of anchor-packer 16.

Whipstock 14, best shown in FIG. 1B, comprises an elongate generally tubular member having an inclined face 40 which, once properly oriented in the borehole, is used to cam starter mill 32 into engagement with the casing 7. The interior of whipstock 14 includes conduit system 15 for conducting hydraulic fluid between running assembly 12 and conduit system 17 of anchor-packer 16.

Running assembly 12 is best shown in FIGS. 1A and 10 and generally comprises MWD subassembly 24, bypass valve 28, running tool 30 and starter mill 32. MWD subassembly 24 is connected at its upper end to high grade drillpipe 22. Connected below MWD sub 24 is a crossover sub 26 and bypass valve 28. Running tool 30 is connected between bypass valve 28 and starter mill 32. As best shown in FIG. 10, starter mill 32 includes a frustoconical extension 34 and a further extending connecting arm 36 which is attached to block 38 on whipstock 14 by shear pin 44. Frustoconical extension 34 includes a central longitudinal bore 33 and a connecting fluid passageway 35. A length of tubing 42 interconnects fluid passageway 35 in extension 34 with the fluid-filled conduit system 15 of whipstock 14.

Figure 4:
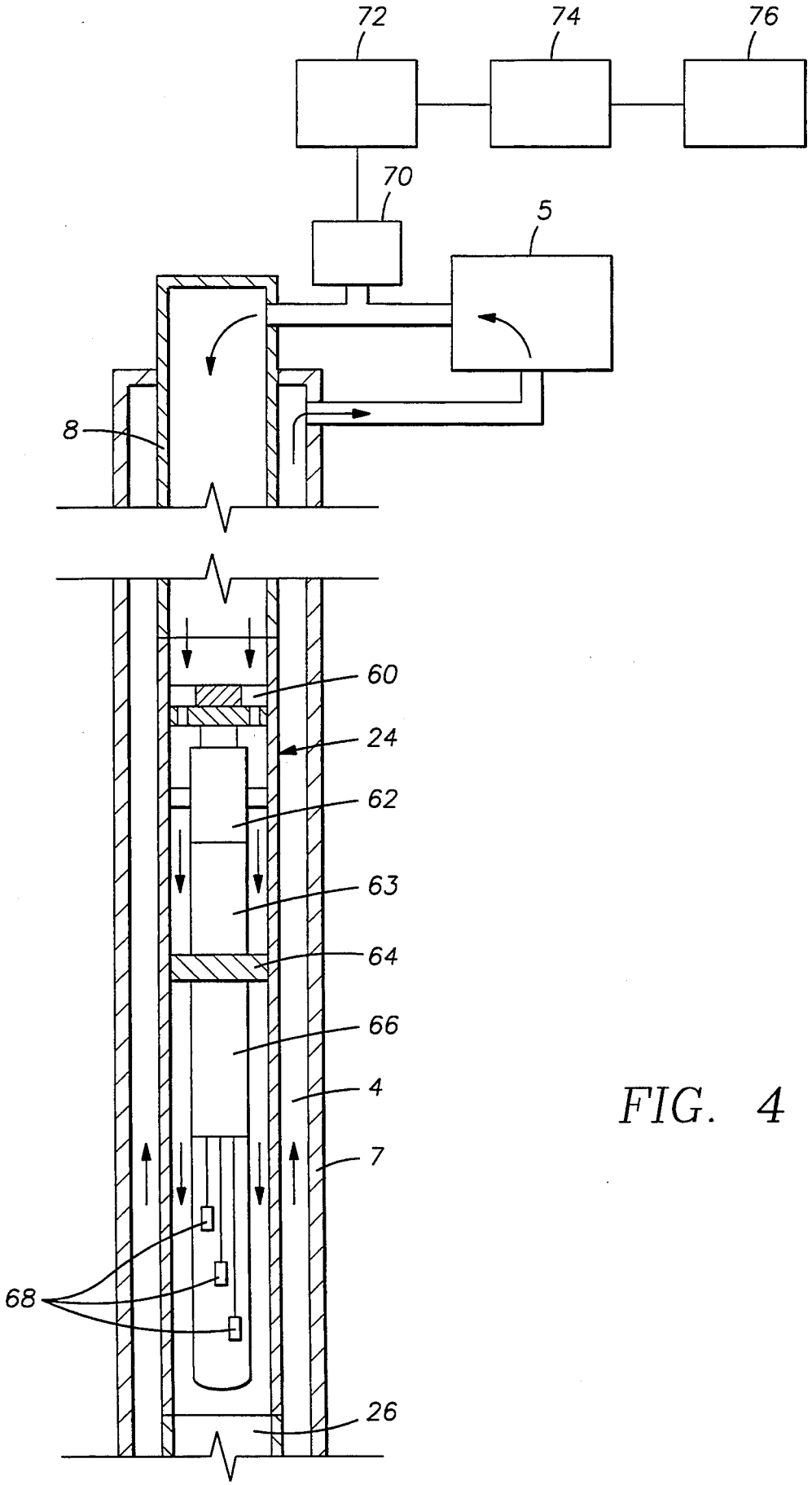
FIG. 4 is a schematic view of the MWD subassembly of FIG. 1A showing the mud pulse telemetry system used in practicing the invention.

To provide the driller with intelligible information at the surface of borehole 6 that is representative of the orientation of the sidetrack system 10, and to provide a variety of other downhole measurements and data, the MWD sub 24 includes a conventional mud pulse telemetry system, the major components of which are shown schematically in FIG. 4. The mud pulse telemetry system is well understood by those skilled in the art, thus only a brief description of the system is provided herein. Referring to FIG. 4, mud pumps 5 located at the surface circulate drilling mud into the top drill string 8. The mud is conducted through drill string 8 into MWD sub 24 where it passes through a mud pulser which includes a siren-type pulser valve 60 that repeatedly interrupts the mud flow to produce a stream of pressure pulses in the circulating drilling mud that can be detected at the surface by pressure transducers 70. Transducers 70 are positioned in the piping system which interconnects mud pumps 5 and drill string 8.

After the mud passes through pulser valve 60 in MWD sub 24, it flows through a turbine 64 which drives a generator 63 which provides electrical power for the MWD components. Alternatively, batteries may be used to provide the needed power. Exiting MWD sub 24, the mud passes through crossover sub 26 and into bypass valve 28. As explained in more detail below, the mud thereafter passes into the annulus 4 formed between drill string 8 and borehole casing 7, the mud being conducted either directly from bypass valve 28 into the annulus 4 or, depending upon the position of bypass valve 28, through running tool 30 and starter mill 32.

Housed in MWD sub 24 are a number of sensors 68 which are shown only schematically in FIG. 4. MWD sensors 68 are typically housed in the wall of MWD sub 24 away from the flow of drilling mud. Such MWD sensors 68 include a three axis accelerometer which measures the earth's gravitational vector relative to the tool axis and a point along the circumference of the tool called a scribe line (not shown), from which the driller can determine the inclination of MWD sub 24 and "tool face." Inclination is the measure of the deviation of the wellbore from vertical. "Tool face" is a measure of the angle between the scribe line relative to the high side of the wellbore. Additionally, sensors 68 include a three axis magnetometer which measures the components of the earth's magnetic field relative to the tool axes. From this measurement and the accelerometer measurements, the driller can determine the azimuth. The azimuth is the directional orientation of the wellbore relative to north.

The rate of rotation of pulser valve 60 is modulated by an electronic controller 62 in response to a train of signals received from an electronic package 66. The measurements and data from the various MWD sensors 68, which are electrically interconnected with electronics package 66, form discrete portions of the control train of signals sent to controller 62 by electronics package 66. Thus, the pressure pulses that are received at the surface by transducers 70 are representative of the directional measurements and other data detected downhole by MWD sensors 68. These signals are then analyzed by computer 72 on a continuous basis to determine the inclination, azimuth and other pertinent information which is displayed to an operator by means of monitor 74 and recorded by recorder 76.

Figure 5:
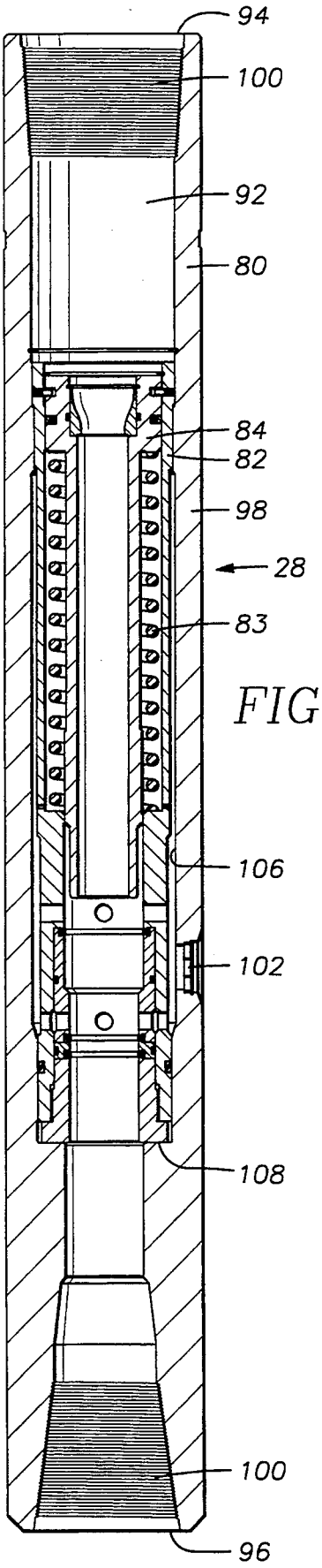
FIG. 5 is a cross-sectional view of the bypass valve shown in FIG. 1A.
Figure 6:
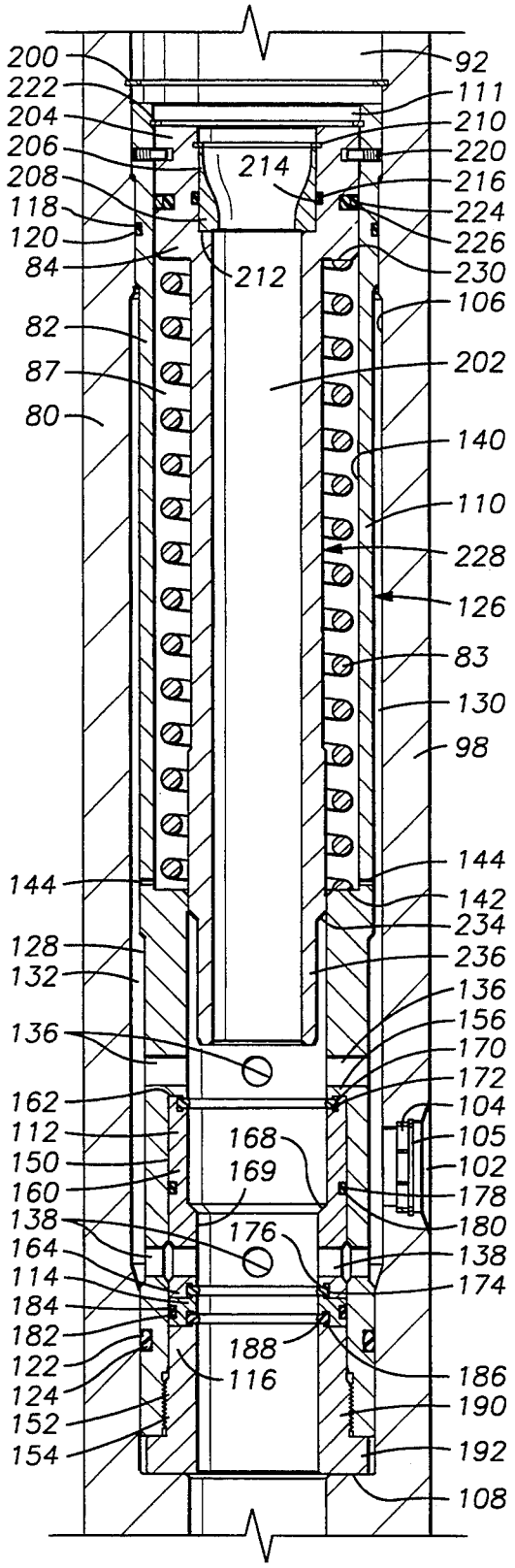
FIG. 6 is an enlarged cross-sectional view of a portion of the bypass valve shown in FIG. 5 with the valve depicted in its initial, fully open position.

Bypass valve 28 is best understood with reference to FIGS. 5–9. Referring first to FIGS. 5 and 6, bypass valve 28 generally includes valve body 80, piston sleeve 82 and a tubular piston 84. Valve body 80 is a generally cylindrical member having wall 98 and a central longitudinal fluid passageway 92 extending between upper end 94 and lower end 96. A box fitting 100 is formed at upper and lower ends 94, 96. Body 80 further includes three mud intake ports 102 (one visible in FIG. 5) to allow drilling fluid to be conducted through wall 98, as explained in more detail below. Each intake port 102 includes a filter ring assembly 104 which is retained in position in intake port 102 by a retaining ring 105. The inner surface of wall 98 includes an annular recess 106 formed along a segment of its length and a lower shoulder 108 for supporting piston sleeve 82.

Referring now to FIG. 6, piston sleeve 82 generally includes tubular member 110, upper seal holder 112, lower seal holder 11 4 and end cap 116. Tubular member 110 includes an upper seal gland 118 and lower seal gland 122 for retaining o-ring seals 120, 124, respectively, which sealingly engage the inner surface of valve body wall 98 above and below annular recess 106. The outer surface of tubular member 110 includes adjoining segments of reduced diameter 126, 128 which are formed on tubular member 110 adjacent to annular recess 106 so as to form a pair of connecting annular chambers 130, 132 between tubular member 110 and valve body wall 98.

Piston sleeve 82 includes a central fluid passageway 111 coaxially aligned with the longitudinal fluid passageway 92 of body 80. Sleeve 82 also includes a series of fluid ports formed to permit drilling fluid to pass between central passageway 111 and lower annular chamber 132. More specifically, in the preferred embodiment of the invention, sleeve 82 includes four upper radial ports 136 and four lower radial ports 138 which are spaced apart longitudinally from the upper ports 136.

Tubular member 110 of sleeve 82 further includes a counterbore 140 formed in its upper end and terminating at shoulder 142. Formed between shoulder 142 and upper seal gland 118 are small-diameter fluid ports 144 which permit drilling fluid to be conducted between upper annular chamber 130 and an annulus 87 that is formed between piston sleeve 82 and piston 84. In the preferred embodiment, tubular member 110 includes two radial ports 144. The lower end of tubular member 110 includes a pair of counterbores 150, 152 for receiving upper seal holder 112, lower seal holder 114 and end cap 116. Lower counterbore 152 includes a threaded region 154 for engaging a correspondingly threaded segment of end cap 116.

Upper seal holder 112 is a tubular element having a generally cylindrical wall 160 with upper end 162 and lower end 164 and an internal annular shoulder 168. Upper end 162 engages shoulder 156 of tubular member 110 and lower end 164 engages lower seal holder 114. Lower radial ports 138 of piston sleeve 82 are formed through the wall 160 of upper seal holder 112 in region 169 that extends between annular shoulder 168 and lower end 164. A seal gland 170 is formed between upper end 162 and shoulder 156 of tubular member 110 for retaining T-seal 172. Similarly, a seal gland 174 is formed between lower end 164 of upper seal holder 112 and lower seal holder 114 for retaining T-seal 176. Upper seal holder 112 further includes seal gland 178 which retains o-ring seal 180, o-ring seal 180 sealing between the inner surface of tubular member 110 and counterbore 150.

Lower seal holder 114 is a ring-like member and includes seal gland 182 for retaining o-ring seal 184 which likewise seals between tubular member 110 and counterbore 150. As explained above, lower seal holder 114, in cooperation with upper seal holder 112, retains T-seal 176 therebetween. In a similar fashion, lower seal holder 114 includes T-seal gland 186 which, in cooperation with end cap 116, retains T-seal 188 therebetween. During assembly of bypass valve 28, upper and lower seal holders 112, 114 are disposed within counterbore 150 of tubular member 110. Thereafter, end cap 116, which includes a threaded segment 190 and flange 192 is threaded into tubular member 110 until flange 192 abuts the lowermost end of tubular member 110 so as to capture T-seals 172, 176 and 186 in their respective seal glands. Flange 192 of end cap 116 rests against shoulder 108 in valve body 80. Piston sleeve 82 is retained in body 80 near its upper end by retaining ring 200 which is disposed in a groove formed in wall 98 of valve body 80.

Referring still to FIG. 6, piston 84 is a generally tubular member having a central fluid passageway 202 coaxially aligned with passageway 92 of valve body 80. The upper end 204 of piston 84 includes a counterbore 206 which receives nozzle 208. Retaining ring 210 retains nozzle 208 disposed against shoulder 212 in counterbore 206. A seal gland 214 is formed in the surface of counterbore 206 to retain o-ring seal 216 which seals between nozzle 208 and the surface of counterbore 206. The invention contemplates interchangeable nozzles such that by interchanging one nozzle for another, the closing characteristics of bypass valve 28 may be altered so as to take into account varying mud weights. In the preferred embodiment, a 11/8× inch nozzle 208 is used for all muds having a weight of 12 pounds per gallon or less, while a $1\frac{1}{4}$ inch nozzle is employed with muds having higher weights.

Tubular piston 84 is shown in FIGS. 5 and 6 in a fixed initial position within piston sleeve 82. With piston 84 in this position, bypass valve 28 is fully open. In the initial position, piston 84 is pinned to piston sleeve 82 by a pair of shear pins 220 which are disposed through aligned holes in the upper ends of piston 84 and sleeve 82. As explained below, once shear pins 220 are severed, piston 84 will be permitted to reciprocate within piston sleeve 82 between the initial position shown in FIGS. 5 and 6 and the final or fully closed position shown in FIG. 9, piston 84 passing between a number of intermediate positions therebetween such as those shown in FIGS. 7 and 8, for example. The flow rate at which bypass valve 28 will close (and thus the rate at which anchor-packer 16 will be set) may be changed by selectively choosing shear pins 220 having the appropriate size and strength. This feature, along with the provisions of having interchangeable nozzles, permits the same bypass valve 28 to be used in a wide variety of applications without requiring significant reconfiguring. For example, the bypass valve 28 thus described may be used with drilling fluids having weights up to 17 pounds per gallon and with MWD tools that require flow rates up to 400 gallons per minute to operate. A retaining ring 222 disposed in a groove in the upper end of piston sleeve 82 defines the upper limit of travel of piston 84. The upper end 204 of piston 84 includes a seal gland 224 which retains a low friction seal 226 such as a teflon impregnated seal for sealingly engaging the inner surface of piston sleeve 82 at a location above shoulder 230.

Piston 84 further includes a central portion 228 of reduced outer diameter so as to form an upper annular shoulder 230 which generally opposes annular shoulder 142 formed on sleeve 82. A spring 83 is disposed between shoulders 230 and 142 in the annulus 87 and provides a biasing force as required to return piston 84 to the initial position shown in FIGS. 5 and 6 when the biasing force exceeds the opposing force created by the fluid pressure of the drilling mud that is circulated through bypass valve 28.

The lower portion of piston 84 includes an annular shoulder 234 which defines a segment of reduced diameter 236. As explained below, shoulder 234, in conjunction with shoulder 168 of upper seal holder 112 combine to form a stop to prevent the further downward movement of piston 84 once it has reached its lowermost or fully closed position shown in FIG. 9. Reduced diameter segment 236 is dimensioned so as to be slidingly received within the central bores of upper and lower seal holders 112, 114 in a very close-fitting relationship. More specifically, reduced diameter segment 236 of piston 84 and region 169 of upper seal holder wall 160 are tightly toleranced. For reasons explained below, it is preferred that piston segment 236 and the cylindrical surface of region 169 be dimensioned such that the diametric clearance between segment 236 and surface 169 is between 0.003 and 0.007 inches, although a diametric clearance within the range of 0.001 to 0.010 inches could also be employed.

Referring now to FIG. 10, running tool 30 is shown connected between bypass valve 28 and starter mill 32. Running tool 30 and starter mill 32 shown therein are well known in the art. Accordingly, internal parts of the running tool and starter mill which are commonly used and understood have been omitted from FIG. 10 for the sake of clarity.

Running tool 30 generally includes an elongate body 240 having a longitudinal throughbore 241 which is comprised of upper and lower segments 242, 244, respectively. Running tool 30 also includes a floating piston 248 disposed in bore 241. Lower segment 244 of bore 241 is larger in diameter than segment 242, and intersects segment 242 at annular shoulder 246. Piston 248 includes seals (not shown) which sealingly engage the inner surface of bore 241 to prevent fluids on one side of piston 248 from mixing with fluids on the other side.

The use of sidetrack system 10 to form a window in a cased borehole, thereby permitting an offsetting wellbore to be formed, begins with the assembly of the system 10. During assembly, tubular piston 84 of bypass valve 28 is pinned in the position shown in FIGS. 5 and 6 by shear pins 220. Bypass valve 28 is connected to running tool 30 in which the piston 248 is initially positioned at position 249 shown in FIG. 10. That portion of bore 241 below initial piston position 249 is filled with hydraulic fluid, as are bore 33 and passageway 35 in starter mill 32. Similarly, tubing 42, the hydraulic conduit system 15 in whipstock 14 and the conduit system 17 of anchor-packer 16 shown in FIG. 1B are also initially filled with hydraulic fluid. Anchor-packer 16 is connected to whipstock 14 by connecting sub 18, and whipstock 14 is suspended from connecting arm 36 of starter mill 32 by shear pin 44 (FIG. 10). Sidetrack system 10 is then run in the borehole 6 by means of drill string 8. As the system 10 is run in the borehole 6, drilling fluid is allowed to enter bypass valve 28 and fill the drill string via mud ports 102 and radial ports 136, 138, best shown in FIG. 6.

When sidetrack system 10 reaches the appropriate elevation in the borehole, as shown in FIGS. 1A and 1B, the drilling mud is circulated through the drill string 8 and running assembly 12 at flow rates as high as 300 gallons per minute in order to operate MWD sub 24 and detect the then-existing orientation of sidetrack system 10 and whipstock 14. Referring to FIG. 6, the drilling mud pumped through MWD sub 24 is conducted into bypass valve 28 through central passageway 92. The flow next passes through nozzle 208 and into fluid passageway 202 of piston 84. Until valve 28 closes as described below, the drilling fluid exits bypass valve 28 through upper and lower radial ports 136, 138, annular chamber 132 and mud ports 102.

With the required rate of mud flow through MWD sub 24, mud pulses representing the orientation of the sidetrack system 10 are sent to the surface for analysis and recording. Given this information, the driller rotates the drill string 8 so as to properly orient inclined surface 40 of whipstock 14. Rotation of the drill string is accomplished by the use of conventional drilling apparatus including a derrick, draw works, rotary table, swivel and kelly joint (not shown) all of which are well understood by those skilled in the art. With whipstock 14 so positioned, the anchor-packer is then set. This is accomplished by increasing the flow rate of the drilling mud to approximately 500 gallons per minute. The increased hydraulic pressure acting against piston 84 severs shear pins 220 and causes piston 84 initially to move very quickly from its position shown in FIG. 6 toward the fully closed position shown in FIG. 9.

Figure 7:
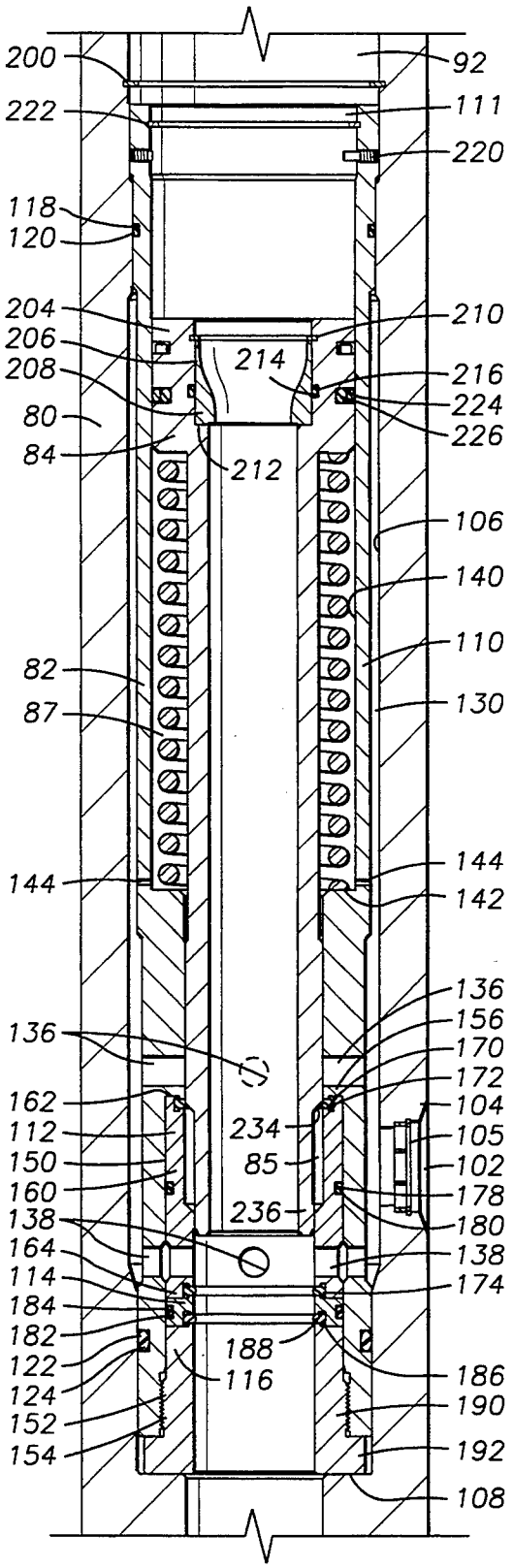
FIG. 7 and FIG. 8 are views similar to FIG. 6, but showing the valve at intermediate positions between the fully open and fully closed positions.
Figure 8:
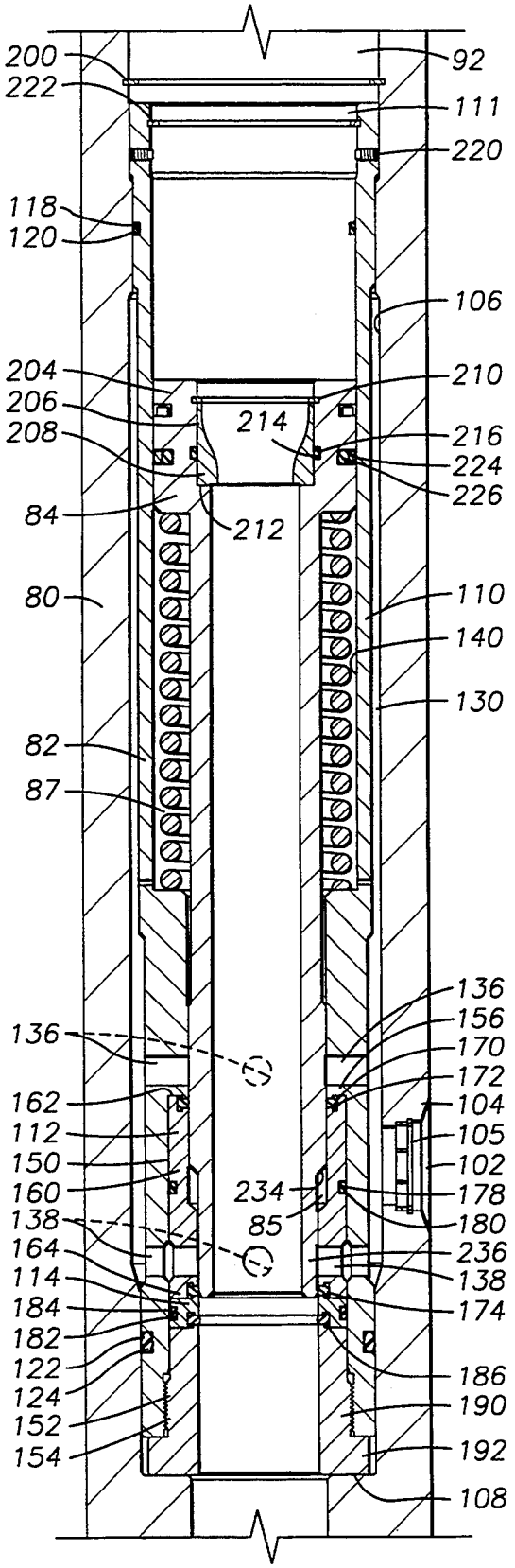

As piston 84 continues to close, it reaches the position shown in FIG. 7 in which upper radial ports 136 in piston sleeve 82 are blocked and sealed by the piston. In this position, piston 84 traps drilling fluid in fluid trap 85. As piston 84 continues to move toward its fully closed position, fluid escapes from fluid trap 85 between the end of piston 84 and the adjacent close-fitting surface of upper seal holder 112. Because of the tight tolerances and resulting small clearance area through which the fluid can escape fluid trap 85, the further movement of piston 84 is retarded so as to dampen the movement of piston 84 and thereby slow the closing of bypass valve 28. With piston 84 in the position shown in FIG. 7, that is, with half of the radial ports 136, 138 in piston sleeve 82 now closed, there will be created an almost instantaneous rise in pressure in the circulating drilling mud. Depending upon the mud weight, the driller's console (not shown) will indicate a pressure rise of approximately 400–500 psi. At this point, using the method of the present invention, the driller will slow down the mud pumps 5 to allow piston 84 to continue to move toward the closed position, but at a slow and controlled rate. Piston 84 thereafter continues to close, moving from a position shown in FIG. 7 to the position shown in FIG. 8 where lower radial ports 138 are also closed by piston 84. The piston 84 eventually moves to the fully closed position shown in FIG. 9 where shoulder 234 of piston 84 engages stop shoulder 168 on upper seal holder 112. Redundant seal 188, together with seal 176, prevent any fluid from escaping bypass valve 28 through the lower radial ports 138.

Figure 2:
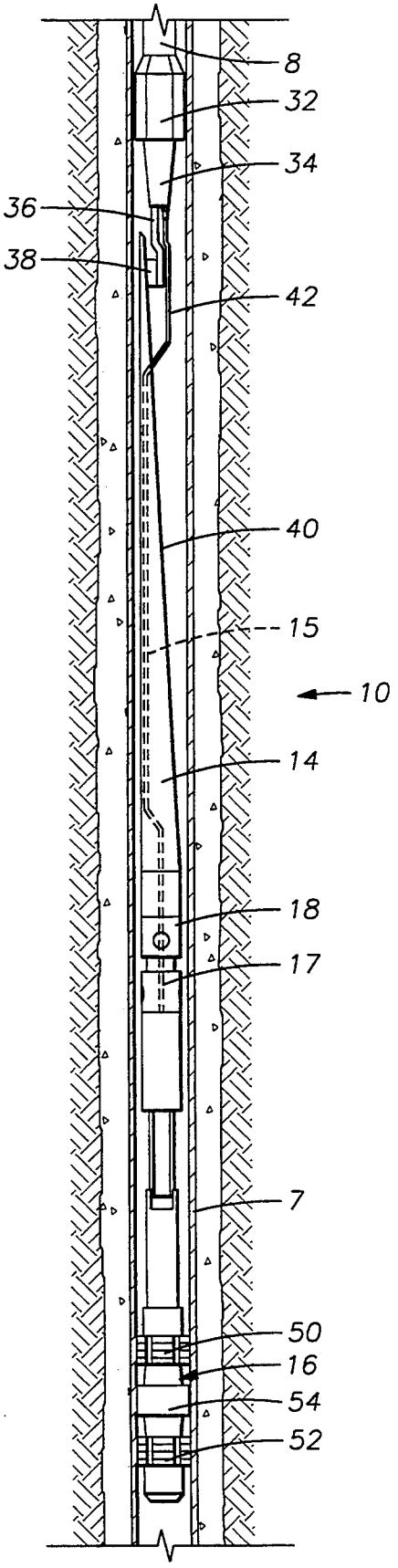
FIG. 2 is a view similar to FIG. 1B and shows the whipstock at the predetermined elevation and orientation and with the anchor-packer set.
Figure 9:
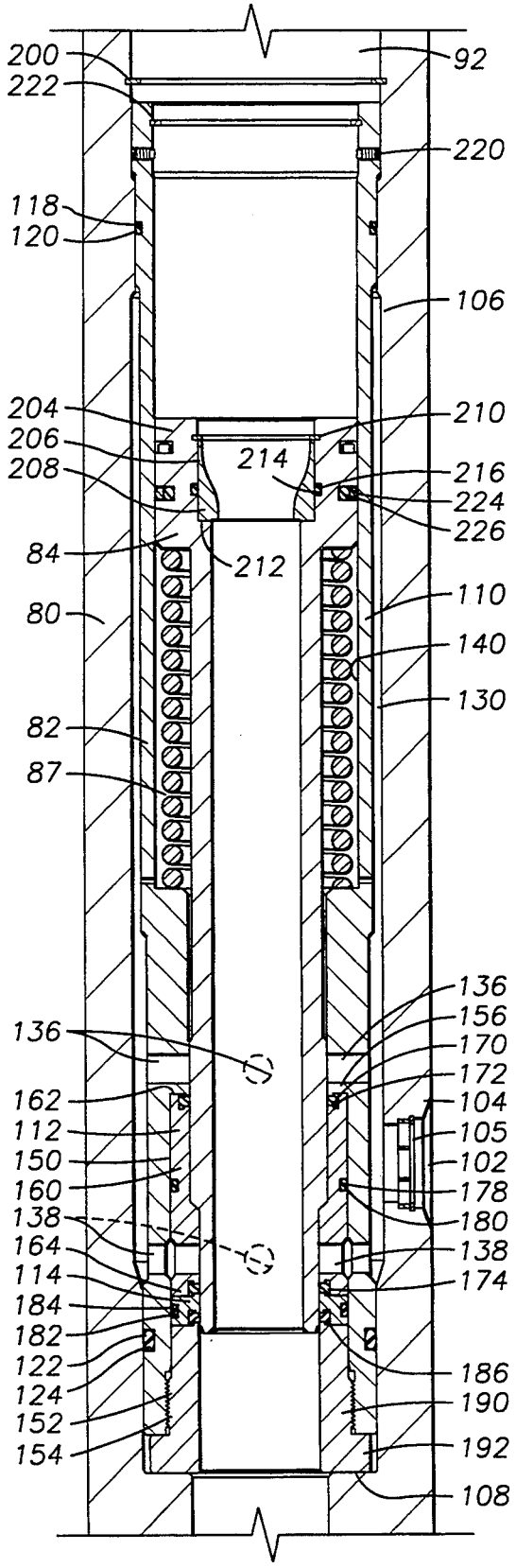
FIG. 9 is another view similar to FIG. 6, but showing the valve in the fully closed position.

Referring now to FIGS. 2, 9 and 10, with bypass valve 28 fully closed, the drilling fluid pressure in running tool 30 will rise. As the fluid pressure rises, piston 248 is forced downwardly in bore 241, thereby also increasing the pressure of the hydraulic fluid that is beneath piston 248 in running tool 30, and in the internal conduit systems 15, 17 of whipstock 14 and anchor-packer 16, respectively. Ultimately, the increased fluid pressure in the conduit system 17 in anchor-packer 16 causes the hydraulically actuated slips 50, 52 and packer seal 54 to engage well casing 7 so as to anchor sidetrack system 10 in the appropriate orientation within the well casing 7, as shown in FIG. 2.

Figure 3:
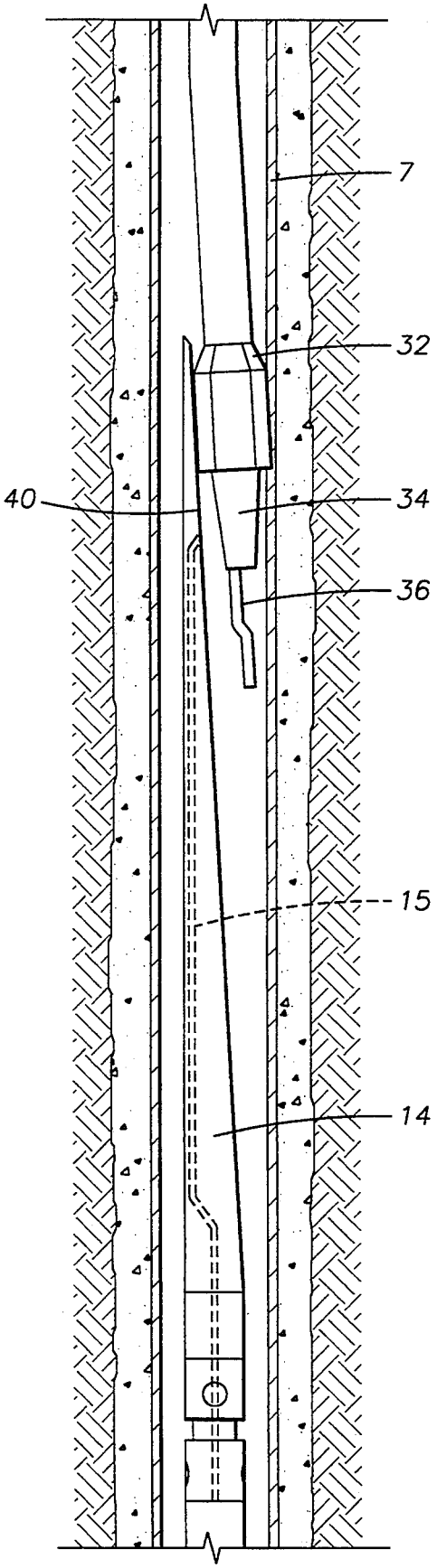
FIG. 3 is a view similar to FIG. 2 and shows the starter mill separated from the whipstock and cammed off the whipstock so as to mill a window in the well casing.

Referring to FIGS. 3 and 10, once whipstock 14 has been oriented and anchored, drill string 8 is lowered or raised so as to sever shear pin 44 and thereby disconnect starter mill 32 from whipstock 14 and sever tubing 42. With tubing 42 severed, the hydraulic fluid below piston 248 escapes into the borehole. With the increased fluid pressure above piston 248, piston 248 in running tool 30 moves downward toward starter mill 32 until it enters lower segment 244 of bore 241 as shown at position 251. Drilling fluid is then permitted to pass around piston 248 into starter mill 32, and the drill string and connected starter mill are rotated. As shown in FIG. 3, as starter mill 32 is both lowered and rotated, it is cammed into casing 7 by inclined surface 40 of whipstock 14 causing the milling of casing 7 to begin. During this process, block assembly 38 is milled off from whipstock 14. After the window is successfully formed in casing 7, the drill string 8 is removed from the borehole. Thereafter, as is known in the art, a window mill is then run in the hole and used to drill the new borehole through the casing window that has been cut by the starter mill.

While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. An apparatus for setting a hydraulically-actuatable mechanism in a borehole and for drilling additional hole in a single trip of the drill string, said apparatus comprising:

a drill string having the hydraulically-actuatable mechanism connected thereto;

an MWD subassembly attached to said drill string and having means for detecting the orientation of said drill string in the borehole when drilling fluid is circulated in said drill string at a flow rate that is within an operational range of flow rates required for operating said MWD subassembly;

means for rotating said drill string to a desired orientation in the borehole;

a cutting assembly attached to said drill string;

means for actuating the hydraulically-actuatable mechanism after said drill string has been rotated to said desired orientation, said actuating means comprising:

a bypass valve in said drill string for controlling the hydraulic pressure exerted on the hydraulically-actuatable mechanism and for controlling the flow of drilling fluid to said cutting assembly, said bypass valve closing and actuating the hydraulically-actuatable mechanism at a drilling fluid flow rate that exceeds said operational range of flow rates for said MWD subassembly.

2. The apparatus of claim 1 wherein said bypass valve does not actuate the hydraulically-actuatable mechanism until drilling fluid is circulated through said valve at a flow rate above 250 gallons per minute.

3. The apparatus of claim 1 wherein said bypass valve begins to close when drilling fluid is circulated through said valve at a flow rate of about 500 gallons per minute.

4. The apparatus of claim 1 further comprising:

a running tool in said drill string disposed between said bypass valve and said cutting assembly, said running tool including a longitudinal throughbore that is divided into a first and a second portion by a reciprocable piston that is disposed in said throughbore, said first portion being filled with drilling fluid and in fluid communication with said bypass valve and said second portion being filled with an actuating fluid and being in fluid communication with said cutting assembly; and conduit means disposed between said cutting assembly and the hydraulically-actuatable mechanism for conducting said actuating fluid therebetween.

5. The apparatus of claim 1 wherein said bypass valve comprises:

a valve body and a piston disposed therein and reciprocatable between a fully open position and a fully closed position and an intermediate position between said fully open and fully closed positions;

means for retaining said piston in said fully open position until the drilling fluid is circulated through said valve at a rate exceeding said operational range of rates;

means for causing said piston to move from said fully open position toward said fully closed position at a first rate of travel after said retaining means has released said piston; and means for changing the rate of travel of said piston after said piston has moved from said fully open position to said intermediate position.

6. The apparatus of claim 5 wherein said changing means comprises a means for hydraulically dampening the movement of said piston from said intermediate position to said fully closed position.

7. The apparatus of claim 6 further comprising a piston sleeve in said bypass valve disposed between said valve body and said piston wherein said dampening means comprises a fluid trap formed between said sleeve and said piston.

8. The apparatus of claim 1 further comprising a whipstock disposed in said drill string in a position between said bypass valve and the hydraulically-actuatable mechanism, said cutting assembly being releasably connected to said whipstock.

9. A bypass valve for controlling the flow of fluid in a drill string, said valve comprising:

a valve body having a generally cylindrical side wall and longitudinal fluid passageway;

a sleeve retained in said valve body having a generally cylindrical side wall and a first and a second fluid port formed through said wall at longitudinally spaced-apart locations;

a piston in said sleeve mounted for reciprocal movement between a first position, a final position, and an intermediate position between said first and said final positions, said piston closing said first fluid port when moved from said first position to said intermediate position and closing said second fluid port when moved from said intermediate position to said final position;

means for retaining said piston in said first position within said sleeve until a predetermined flow rate of the fluid is conducted through the drill string;

means for conducting the fluid through said side wall of said valve body when said piston is in said first position and in said intermediate position.

10. The valve of claim 9 wherein said retaining means retains said piston in said first position at all fluid flow rates less than about 250 gallons per minute.

11. The valve of claim 10 wherein said retaining means retains said piston in said first position until the fluid flow rate is approximately 500 gallons per minute.

12. The valve of claim 9 further comprising means for hydraulically retarding the movement of said piston from said intermediate position to said final position.

13. The valve of claim 12 wherein said hydraulic retarding means comprises a fluid trap that is formed between said piston and said sleeve when said piston closes said first fluid port.

14. A bypass valve comprising:

a valve body having a generally cylindrical outer wall and a longitudinally aligned fluid passageway;

a tubular sleeve retained in said valve body having a longitudinal fluid passageway in fluid communication with said passageway of said valve body;

an annular chamber between said sleeve and said valve body;

an aperture in said outer wall of said valve body, said aperture intersecting said annular chamber to permit fluid in said chamber to pass outside said valve body;

a first radial port formed in said sleeve and interconnecting said annular chamber and said fluid passageway of said sleeve;

a second radial port formed in said sleeve at a location spaced apart longitudinally from said first radial port, said second radial port interconnecting said annular chamber and said fluid passageway of said sleeve;

a piston mounted for reciprocal movement in said sleeve, said piston moveable between a first position, an intermediate position and a final position and having a fluid passageway in fluid communication with said fluid passageway of said sleeve;

wherein said piston closes said first radial port when said piston moves from said first position to said intermediate position and;

wherein said piston closes said second radial port when said piston moves from said intermediate position to said final position.

15. The bypass valve of claim 14 further comprising at least one shear pin disposed between said sleeve and said piston for retaining said piston in said first position until a fluid flow of a predetermined rate greater than 250 gallons per minute is conducted through said valve body.

16. The bypass valve of claim 14 further comprising means for retarding movement of said piston as it moves from said intermediate position to said final position.

17. The bypass valve of claim 16 wherein said retarding means comprises a fluid trap formed between said sleeve and said piston when said piston is in said intermediate position.

18. The bypass valve of claim 17 wherein said fluid trap comprises an annular chamber having first and second ends, said chamber being sealed at said first end at a location between said first and second radial ports and unsealed at its second end so as to be in fluid communication with said fluid passageway of said sleeve.

19. The bypass valve of claim 18 further comprising means for restricting the flow of fluid from said annular chamber of said fluid trap into said passageway of said sleeve.

20. The bypass valve of claim 19 wherein said restricting means comprises a region of close tolerances between said piston and said sleeve located between said first and second radial ports such that the diametric clearance between said sleeve and said piston in said region of close tolerances is between 0.001 and 0.010 inches.

21. The bypass valve of claim 17 wherein said fluid trap decreases in volume as said piston moves from said intermediate position to said final position.

22. The bypass valve of claim 18 further comprising an annular shoulder formed on said sleeve between said first and second radial ports, said shoulder forming a piston stop to prevent said piston from moving beyond said final position.

23. The bypass valve of claim 22 further comprising an annular shoulder formed on said piston for engaging said shoulder of said sleeve when said piston moves to said final position.

24. The bypass valve of claim 14 wherein said sleeve includes first and second ends, said valve further comprising:

first seal means for sealing between said sleeve and said piston when said piston is in said intermediate position, said first seal means being disposed at a location between said first and second radial ports;

second seal means for sealing between said sleeve and said piston when said piston is in said final position, said second seal means being disposed at a location between said second radial port and said second end of said sleeve.

25. A bypass valve for use in a drill string comprising:

a valve body having a longitudinal fluid passageway therethrough;

a tubular sleeve assembly retained in said valve body and having an internal piston-engaging surface;

a first annular chamber formed between said valve body and said sleeve assembly;

first seal means for sealing said first annular chamber;

a fluid port formed through said valve body into said first annular chamber;

a piston disposed in said sleeve assembly, said piston having a longitudinal throughbore formed therein;

opposing annular shoulders on said piston and said sleeve assembly, said opposing shoulders forming a second annular chamber between said sleeve assembly and said piston;

a spring disposed about said piston in said second annular chamber;

releasable means for retaining said piston at a first position relative to said sleeve assembly until drilling fluid is conducted through said valve at a predetermined flow rate;

a first plurality of radial ports formed in said sleeve assembly between said piston-engaging surface and said first annular chamber;

a second plurality of radial ports formed in said sleeve assembly between said piston-engaging surface and said first annular chamber, said second plurality of ports being spaced apart longitudinally from said first plurality of ports;

wherein said first and second plurality of radial ports are open when said piston is in said first position;

means for causing said retaining means to release said piston and for causing said piston to move longitudinally from said first position to a second position, said piston closing said first plurality of radial ports but not said second plurality of radial ports when in said second position.

26. The bypass valve of claim 25 further comprising:

a piston stop on said sleeve assembly defining the limit of travel of said piston in said sleeve assembly and engaging said piston when said piston moves from said second piston to a third position;

wherein said piston closes said first and second plurality of radial ports when in said third position.

27. A method of setting a hydraulically-actuatable mechanism and commencing drilling in a single trip of a drill string comprising the steps of:

assembling a drill string having a MWD subassembly capable of detecting downhole parameters and communicating the detected data to the surface of the borehole, a bypass valve for directing the flow of drilling fluid through the drill string, a cutter assembly and the hydraulically-actuatable mechanism;

running the assembled drill string in the borehole and positioning the hydraulically-actuatable mechanism at a predetermined location;

sensing the orientation of the drill string using the MWD subassembly;

orienting the drill string in the desired orientation;

exerting a fluid pressure through the drill string to set the hydraulically-actuatable mechanism;

lowering and rotating the drill string to release the cutter assembly from the hydraulically-actuatable mechanism and to commence drilling.

28. The method of claim 27 wherein the step of sensing the orientation of the drill string comprises the steps of:

pumping drilling fluid through the MWD subassembly and bypass valve at a flow rate required to operate the MWD subassembly and gather the desired downhole data and at a flow rate less than that required for setting the hydraulically-actuatable mechanism.

29. The method of claim 28 wherein the step of setting the hydraulically-actuatable mechanism comprises the steps of:

increasing the flow rate of the drilling fluid to the flow rate required to set the hydraulically-actuatable mechanism.

* * * * *